US005313030A

United States Patent [19]

Kusserow et al.

[11] Patent Number: 5,313,030

[45] Date of Patent: May 17, 1994

[54] VACUUM SWITCH

[75] Inventors: Joerg Kusserow, Neuenhagen; Roman Renz, Berlin, both of Fed. Rep. of Germany

[73] Assignee: Siemens Aktiengesellschaft, Munich, Fed. Rep. of Germany

[21] Appl. No.: 55,123

[22] Filed: Apr. 29, 1993

[51] Int. Cl.[5] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,980,850 | 9/1976 | Kimblin | 200/144 B |
| 4,620,074 | 10/1986 | Paul et al. | 200/144 B |
| 4,727,228 | 2/1988 | Hoene et al. | 200/144 B |
| 4,737,605 | 4/1988 | Bettge et al. | 200/144 B |
| 4,795,866 | 1/1989 | Hoene et al. | 200/144 B |
| 5,004,877 | 4/1991 | Yin | 200/144 B |
| 5,064,976 | 11/1991 | Blalkowski et al. | 200/144 B |
| 5,168,139 | 12/1992 | Bettge et al. | 200/144 B |

FOREIGN PATENT DOCUMENTS

| | | |
|---|---|---|
| 0155376 | 9/1985 | European Pat. Off. . |
| 2443141 | 7/1975 | Fed. Rep. of Germany . |
| 2535150 | 2/1977 | Fed. Rep. of Germany . |
| 1915198 | 6/1977 | Fed. Rep. of Germany . |
| 2612129 | 11/1978 | Fed. Rep. of Germany . |
| 2725092 | 12/1978 | Fed. Rep. of Germany . |
| 3302226 | 7/1984 | Fed. Rep. of Germany . |
| 3709585 | 10/1987 | Fed. Rep. of Germany . |
| 3717864 | 11/1988 | Fed. Rep. of Germany . |
| 1196121 | 6/1970 | United Kingdom . |

OTHER PUBLICATIONS

Elektrizitätswirtschaft, Jg. 91 (1992), No. 4; Karl Stegmüller et al.: *Vakuumschaltkammern mit axial wirkendem Magnetfeld.*

Siemens Prospectus: *Mittelspannung/ Vakuumschalttechnik (Medium Range Voltage/Vacuum Technology)* No. A19100-E769-B162, p. 8: *Aufbau und Aufgaben der zwei Baureihen 3AF und 3 AG.*

*Primary Examiner*—J. R. Scott

*Attorney, Agent, or Firm*—Kenyon & Kenyon

[57] ABSTRACT

A vacuum switching tube has a cylindrical housing, including an insulator which directly surrounds contact pieces of the tube. The radial distance of the insulator from the contact pieces is less than or at most equal to the length of the contact stroke. In addition, the contact pieces can be structured as axial magnetic field contacts, and the free cross-section can be narrowed in the back space of the contact pieces by radial expansion at the contact pins or by radial constriction of the insulator.

12 Claims, 1 Drawing Sheet

VACUUM SWITCH

BACKGROUND OF THE INVENTION

The present invention relates to the field of energy distribution. More particularly, the present invention pertains to the structure of a vacuum switching tube in which switching contacts are directly surrounded by an insulating housing.

Vacuum switches are used to interrupt current in energy distribution networks. They are also used in power supplies for large power consumption devices. Vacuum switches essentially include a vacuum switching tube and a drive device. The vacuum switching tube is the actual switching element, and it has an axially movable contact piece that is rigidly coupled with the drive device. The drive device is designed such that a certain distance between contacts exists when the switch is closed. This distance is denoted the contact stroke.

German Patent No. DE 19 15 198 discloses a vacuum switching tube that has a housing which includes a metallic hollow cylinder in the region of the contact pieces. The metallic hollow cylinder directly surrounds the contact pieces. Hollow cylinder insulators, generally made of ceramic material, are soldered on at both ends.

In addition to the aforementioned vacuum switching tubes, it is also common to provide a cylindrical housing in the vacuum switching tube which comprises one or two axially adjacent insulators as disclosed in German Patent Nos. DE 25 35 150, DE 26 12 129, DE 27 25 092. In these switches, a hollow cylindrical metal shield is provided to protect an inner wall of the insulator against the condensation of metal vapor. This metal shield surrounds the contact pieces directly, at a distance, and is attached to either the insulator, at the seam of the two insulators, or to one of the two end plates of the housing.

A vacuum switching tube disclosed in U.S. Pat. No. 5,004,877 has a hollow cylinder insulator as an axially extending housing part and no metal shield is provided between the contact pieces and the insulator. A metal shield is attached to the fixed contact pin at one end of the insulator to prevent the condensation of metal vapor.

SUMMARY OF THE INVENTION

A vacuum switching tube of the present invention can include a fixed contact piece and an axially movable contact piece, a cylindrical housing surrounding the contact pieces having two end surfaces and a hollow cylinder insulator, a metallic end plate at each end surface of the cylindrical housing, and a contact pin connecting the contact pieces with its corresponding end plate. The distance of the insulator from each of the contact pieces is less than or equal to the contact stroke.

The present invention provides a vacuum switching tube structure in which that the insulation capacity of the insulator is reliably maintained without the use of a metal shield.

To do so the present invention provides that the radial distance of the insulator from the contact pieces is less than or at most equal to the contact stroke.

With such a structure of the vacuum switching tube, metal vapor condensation onto the insulator takes place only in a limited area, by minimizing the distance between the contact pieces and the surrounding insulator.

The remaining surface areas of the insulator, where no condensation occurs, are sufficient to maintain the required insulation capacity. The condensation onto the insulator, only in the region of the contact pieces, can additionally limited, particularly in the case of shut. off currents in the range from 12 to 25 kA. This is accomplished by structuring the contact pieces as axial magnetic field contacts. In this manner, the magnetic shielding effect of axial magnetic fields is utilized. This is because, under the effect of the flowing current, a magnetic cage is formed. The cage at least partially prevents the exit of metal vapor from the region between the two contacts towards the outside. Vacuum switching tubes structured according to the present invention can be particularly used for vacuum switches operated in lower power ranges, and thus for switch short-circuit currents of at most 25 kA. These tubes can be predicted, on the basis of the operating conditions, to only have to withstand a small number of short-circuit current interruptions during their lifetime.

The free cross-section between the contact pin in question and the insulator is narrowed in the region between the contact pieces and one or both end plates. This helps support the effect achieved by the sizing that metal vapor condensation onto the insulator takes place only in a limited area. The narrowing can take place, for example, by means of a disk or a plate-like piece, which is attached to one or both contact pins. It can also be attached at the bottom of one or both contact pieces. In this connection, it is advantageous if the free cross-section is limited to a gap width which is less than or at most equal to half the contact stroke. However, it is also possible for the insulator to be provided with a ring-shaped projection which projects radially inward, in the region of the back space of one or both contact pieces. This ring-shaped projection stops metal vapor from diffusing to the region of the insulator wall between this ring-shaped projection and the end plate. Thus metal vapor condensation onto the insulator takes place only in a limited area.

DETAILED DESCRIPTION

Figure 1:
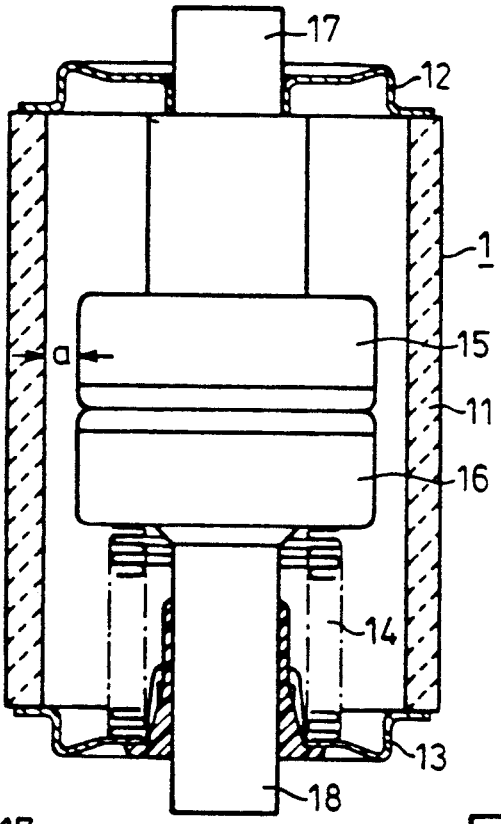
FIG. 1 illustrates a vacuum switching tube according to a first embodiment of the present invention.

FIG. 1 illustrates a vacuum switching tube in accordance with a first embodiment of the present invention. The vacuum switching tube shown in FIG. 1 comprises a housing 1 which includes a hollow cylinder ceramic insulator 11, two metallic end plates 12 and 13 and a spring bellows 14. Within the housing, 1 in a vacuum-sealed manner, the two contacts or contact pieces 15 and 16 are arranged with their contact pins 17 and 18 leading out and soldered onto end plate 12 and spring bellows 14, respectively. Insulator 11 has a radial distance "a" from contact pieces 15 and 16, which can be radial or axial magnetic field contacts. The distance is selected to be less than the rated contact stroke of the axially movable contact piece 16. In this connection, the contact stroke of the movable switch contact 16 amounts to approximately 14 mm.

Figure 2:
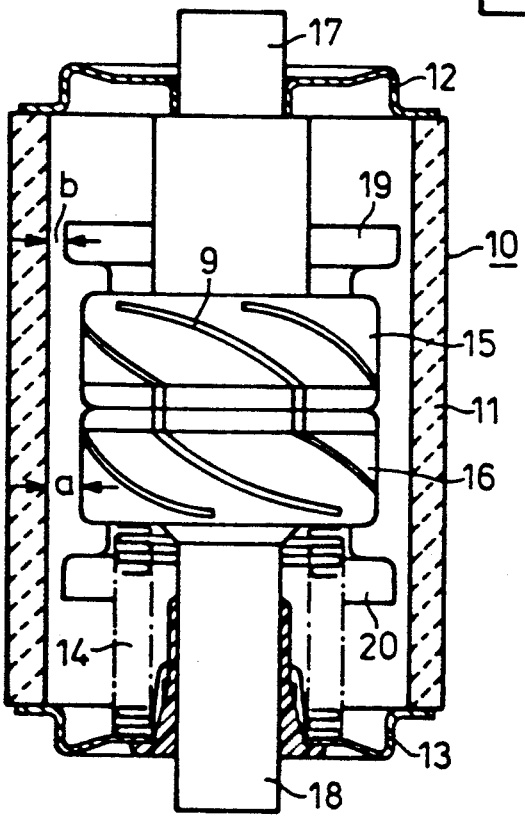
FIG. 2 illustrates a further embodiment of a vacuum switching tube according to the present invention.

A further embodiment of the present invention is illustrated in FIG. 2. The housing of the vacuum switching tube 10 shown in FIG. 2 includes a hollow cylinder ceramic insulator 11, two metallic end plates 12 and 13 and spring bellows 14. Within the housing, the two contact pieces 15 and 16 are arranged with their contact pins 17 and 18 leading out. Contact pieces 15 and 16 are known pot contacts, which are structured as axial magnetic field contacts by means of a slit 9 provided therein. Instead of pot contacts (see, e.g., EP-0 155 376), other axial magnetic field contacts (see, e.g., DE 24 43 141) can also be used.

The inside diameter of ceramic insulator is selected in such a way that a radial distance "a" of the switch contacts 15 and 16 from the insulator 11 is less than or at most equal to the rated switching stroke of the contact 16. At the bottom of contact pieces 15 and 16 are soldered plate-like pieces 19 and 20, respectively. These plate-like pieces 19 and 20 narrow the free cross-section in the back space of the two contacts 15 and 16 to a radial gap having a width "b" that is less than or at most equal to half the rated contact stroke of the switch contact 16.

Figure 3:
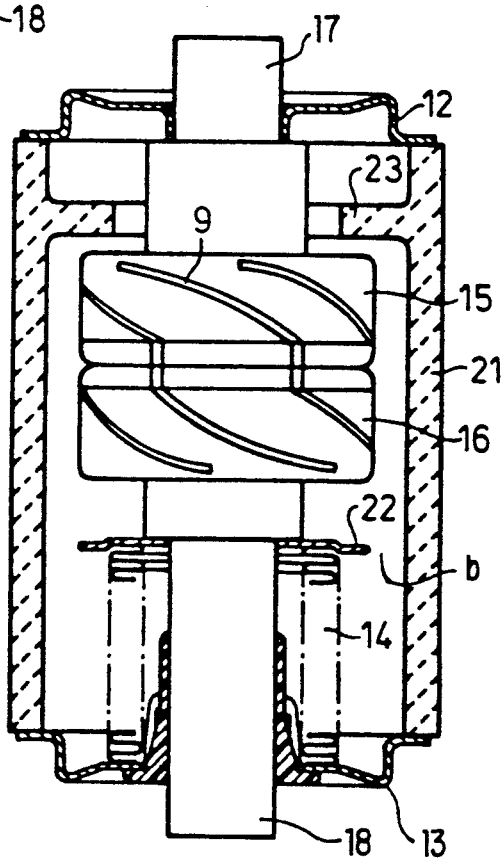
FIG. 3 illustrates yet another embodiment of the vacuum switching tube according to the present invention.

In the vacuum switching tube according to another embodiment of the present invention, shown in FIG. 3, the radial distance of the two switch contacts 15 and 16 from the insulator 21 is also selected to be less than, or at most equal to, the rated contact stroke. To narrow the cross-section in the back space of switch contact 16, the centering disk 22 for the folded bellows 14 is radially widened, so that the remaining gap width b is at most equal to half the contact stroke. In the back space of switch contact 15, the radial gap of the ceramic insulator 21 is narrowed by a ring-shaped projection 23 such that the adjacent wall region of the insulator 21 is reliably shaded from metal vapor condensation in the direction towards the end plate 12.

What is claimed is:

1. A vacuum switching tube, comprising:
a fixed contact piece;
an axially movable contact piece having a predetermined contact stroke;
a cylindrical housing surrounding said fixed and axially movable contact pieces, said cylindrical housing having two end surfaces and at least one hollow cylinder insulator, said cylindrical insulator surrounding said fixed and axially movable contact pieces;
wherein a radial distance of said insulator from each of said contact pieces is less than or equal to said contact stroke;
a metallic end plate arranged at each of said end surfaces of said cylindrical housing; and
a contact pin associated with each of said contact pieces, each contact pin connecting a corresponding contact piece with its corresponding metallic end plate.

2. The vacuum switching tube of claim 1, wherein said contact pieces are structured as axial magnetic field contacts.

3. The vacuum switching tube of claim 1 further comprising:
a disk attached to one of said contact pins;
wherein a radial distance between said disk and said cylindrical insulator is narrower than said radial distance of said insulator from each of said contact pieces.

4. The vacuum switching tube of claim 1 further comprising:
a disk attached to the bottom of at least one of said contact pieces;
wherein a radial distance between said disk and said cylindrical insulator is narrower than said radial distance of said insulator from said at least one of said contact pieces.

5. The vacuum switching tube of claim 1 further comprising:
a plate-like piece attached to one of the contact pins;
wherein a radial distance between said plate-like piece and said cylindrical insulator is narrower than said radial distance of said insulator from each of said contact pieces.

6. The vacuum switching tube of claim 1 further comprising:
a plate-like piece attached to the bottom of at least one of said contact pieces;
wherein a cross-section between said plate-like piece said cylindrical insulator is narrower than said radial distance of said insulator from each of said contact pieces.

7. The vacuum switching tube of claim 2 further comprising:
a disk attached to one of said contact pins pin;
wherein a radial distance between said disk and said cylindrical insulator is narrower than said radial distance of said insulator from each of said contact pieces.

8. The vacuum switching tube of claim 2 further comprising:
a disk attached to the bottom of at least one of said contact pieces;
wherein a radial distance between said disk and said cylindrical insulator is narrower than said radial distance of said insulator from said at least one of said contact pieces.

9. The vacuum switching tube of claim 2 further comprising:
a plate-like piece attached to one of the contact pins;
wherein a radial distance between said plate like piece and said cylindrical insulator is narrower than said radial distance of said insulator from each of said contact pieces.

10. The vacuum switching tube of claim 2 further comprising:
a plate-like piece attached to the bottom of at least one of said contact pieces;
wherein a cross-section between said plate-like piece said cylindrical insulator is narrower than said radial distance of said insulator from each of said contact pieces.

11. The vacuum switching tube of claim 1 further comprising:
a ring-shaped projection which projects radially inward from said insulator in a region of a back space of at least one of said contact pieces.

12. The vacuum switching tube of claim 2 further comprising:
a ring-shaped projection which projects radially inward from said insulator in a region of a back space of at least one of said contact pieces.

* * * * *